US009075343B2

(12) United States Patent
Nishimura et al.

(10) Patent No.: US 9,075,343 B2
(45) Date of Patent: Jul. 7, 2015

(54) IMAGE FORMING DEVICE HAVING DETACHABLE DEVELOPING DEVICE UNIT

(71) Applicant: Brother Kogyo Kabushiki Kaisha, Nagoya-shi, Aichi-ken (JP)

(72) Inventors: Yoh Nishimura, Nagoya (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/290,567

(22) Filed: May 29, 2014

(65) Prior Publication Data

US 2014/0270850 A1 Sep. 18, 2014

Related U.S. Application Data

(63) Continuation of application No. 13/906,692, filed on May 31, 2013, now Pat. No. 8,744,308, which is a continuation of application No. 13/347,983, filed on Jan. 11, 2012, now Pat. No. 8,467,703, which is a continuation of application No. 12/406,246, filed on Mar. 18, 2009, now Pat. No. 8,107,855.

(30) Foreign Application Priority Data

Jun. 24, 2008 (JP) ..... 2008-164972

(51) Int. Cl.
*G03G 21/16* (2006.01)
*G03G 15/01* (2006.01)
*G03G 15/08* (2006.01)

(52) U.S. Cl.
CPC .... *G03G 15/0865* (2013.01); *G03G 2215/0132* (2013.01); *G03G 2221/163* (2013.01);
(Continued)

(58) Field of Classification Search
CPC ..... G03G 15/0865; G03G 15/0808; G03G 21/1623; G03G 21/1647; G03G 21/1671; G03G 21/1676; G03G 2215/0132; G03G 2221/163; G03G 2221/1651; G03G 2221/1684; G03G 2221/1869
USPC ..... 399/112, 113, 119, 223
See application file for complete search history.

(56) References Cited

U.S. PATENT DOCUMENTS 6,522,850 B2 2/2003 Hiroki
6,947,686 B2 9/2005 Kawai et al.
(Continued)

FOREIGN PATENT DOCUMENTS

JP 01-244477 A 9/1989
JP H02-033912 U 3/1990
(Continued)

OTHER PUBLICATIONS

JP Office Action dtd Jul. 27, 2010, JP Appln. 2008-164972, English translation.
(Continued)

*Primary Examiner* — Sophia S Chen
(74) *Attorney, Agent, or Firm* — Banner & Witcoff, Ltd.

(57) ABSTRACT

An image forming device includes a plurality of developing devices, and a plurality of sloping members disposed in one-to-one correspondence with the plurality of developing devices. Each developing device includes a developer accommodating chamber and a developing roller disposed above the developer accommodating chamber. Each developing device is movable between a first position and a second position lower than the first position in a height direction generally parallel to a vertical direction. Each sloping member has a sloped surface movable in the height direction and a biasing member biasing the sloped surface upward in the height direction. Each sloping member is movable between a third position where the corresponding developing device is placed on the sloped surface and a fourth position where the corresponding developing device is released from being pressed by the sloped surface in a predetermined direction generally perpendicular to the vertical direction.

13 Claims, 8 Drawing Sheets

(52) U.S. Cl.
CPC ..... *G03G2221/1651* (2013.01); *G03G 2221/1684* (2013.01); *G03G 2221/1869* (2013.01); *G03G 21/1623* (2013.01); *G03G 21/1647* (2013.01); *G03G 21/1671* (2013.01); *G03G 21/1676* (2013.01); *G03G 15/0808* (2013.01)

(56) References Cited

U.S. PATENT DOCUMENTS

| | | | | |
|---|---|---|---|---|
| 6,978,103 | B2 | 12/2005 | Miura et al. | |
| 7,155,148 | B2 | 12/2006 | Nishimura et al. | |
| 7,203,446 | B2 | 4/2007 | Miura et al. | |
| 7,463,847 | B2 | 12/2008 | Sato | |
| 7,551,877 | B2 | 6/2009 | Murayama | |
| 8,107,855 | B2 | 1/2012 | Nishimura et al. | |
| 8,467,703 | B2 | 6/2013 | Nishimura et al. | |
| 8,744,308 | B2 * | 6/2014 | Nishimura et al. | 399/113 |
| 2003/0007808 | A1 | 1/2003 | Hiroki | |
| 2003/0161656 | A1 | 8/2003 | Miura et al. | |
| 2003/0185587 | A1 | 10/2003 | Kawai et al. | |
| 2005/0147432 | A1 | 7/2005 | Miura et al. | |
| 2006/0140673 | A1 | 6/2006 | Kamimura et al. | |
| 2006/0140674 | A1 | 6/2006 | Sato | |
| 2007/0286639 | A1 | 12/2007 | Murayama | |

FOREIGN PATENT DOCUMENTS

| | | | |
|---|---|---|---|
| JP | 2002-099129 | A | 4/2002 |
| JP | 2003-021944 | A | 1/2003 |
| JP | 2003-241621 | A | 8/2003 |
| JP | 2003-316233 | A | 11/2003 |
| JP | 2006-184553 | A | 7/2006 |
| JP | 2007-328300 | A | 12/2007 |

OTHER PUBLICATIONS

JP Office Action dtd Nov. 24, 2010, JP Appln. 2008-164972, English translation.
JP Office Action dtd Nov. 30, 2010, JP Appln. 2010-213471, English translation.
JP Office Action dated Sep. 13, 2011, corresponding JP Application No. 2011-094737; English translation.
JP Office Action mailed Feb. 28, 2012, JP Appln. 2011-094737, English translation.

* cited by examiner

IMAGE FORMING DEVICE HAVING DETACHABLE DEVELOPING DEVICE UNIT

CROSS REFERENCE TO RELATED APPLICATION

This application is a continuation application of U.S. patent application Ser. No. 13/906,692 filed May 31, 2013, which is a continuation application of U.S. patent application Ser. No. 13/347,983 filed Jan. 11, 2012, which is a continuation application of U.S. patent application Ser. No. 12/406,246 filed Mar. 18, 2009 and claims priority from Japanese Patent Application No. 2008-164972 filed Jun. 24, 2008. The entire contents of the above noted applications are incorporated herein by reference.

TECHNICAL FIELD

The present invention relates to an image forming device such as a laser printer.

BACKGROUND

As a conventional electrophotographic image forming device such as a laser printer, Japanese laid-open patent publication No. 2006-1844553 discloses an image forming device including a photosensitive drum unit provided with a plurality of photosensitive drums, and a developing device unit (developing device tray) provided with a plurality of developing devices. The photosensitive drum unit and developing device unit are configured to be detachably mounted in the main body of the image forming device.

In this image forming device, however, when the developing device unit is being removed from the main body, first the entire developing device unit is necessary to be detached from the photosensitive drum unit for separating the developing rollers of the developing devices from the photosensitive drum unit. The developing device unit is then to be pulled out from the main body. Hence, this image forming device necessitates a large-sized mechanism for supporting the weight of the whole developing device unit as well as for allowing the developing device unit to be movable.

SUMMARY

In view of the foregoing, it is an object of the present invention to provide an image forming device having a simple-structured mechanism that enables a developing device unit to be detachably mounted in a main body of the image forming device.

In order to achieve the above and other objects, the present invention provides an image forming device including: a plurality of developing devices; and a plurality of sloping members disposed in one-to-one correspondence with the plurality of developing devices. Each of the plurality of developing devices includes a developing roller defining an axis line and a developer accommodating chamber configured to accommodate developer therein, each of the plurality of developing rollers being disposed above the developer accommodating chamber such that the axis line extends in a direction generally perpendicular to a vertical direction, each of the plurality of developing devices being movable between a first position and a second position lower than the first position in a height direction generally parallel to the vertical direction. Each of the plurality of sloping members has a sloped surface that is movable in the height direction and including a biasing member configured to bias the sloped surface upward in the height direction, each of the plurality of sloping members being movable between a third position where the corresponding developing device is placed on the sloped surface and a fourth position where the corresponding developing device is released from being pressed by the sloped surface in a predetermined direction generally perpendicular to the vertical direction.

BRIEF DESCRIPTION OF THE DRAWINGS

The particular features and advantages of the invention as well as other objects will become apparent from the following description taken in connection with the accompanying drawings, in which:

FIGS. 2A to 2C are explanatory diagrams showing a color developing position of a developing device unit according to an embodiment of the present invention, wherein FIG. 2A shows an external configuration of the developing device unit and a photosensitive drum unit, FIG. 2B is a partially enlarged view of FIG. 2A, and FIG. 2C shows an internal configuration of the developing device unit and the photosensitive drum unit;

FIGS. 3A to 3C are explanatory diagrams showing an intermediate position of the developing device unit, wherein FIG. 3A shows an external configuration of the developing device unit and the photosensitive drum unit, FIG. 3B is a partially enlarged view of FIG. 3A, and FIG. 3C shows an internal configuration of the developing device unit and the photosensitive drum unit;

FIGS. 4A to 4D are explanatory diagrams showing a detachable position of the developing device unit, wherein FIG. 4A shows an external configuration of the developing device unit and the photosensitive drum unit, FIG. 4B is a partially enlarged view of FIG. 4A, FIG. 4C shows an internal configuration of the developing device unit and the photosensitive drum unit, and FIG. 4D is an enlarged view of a hook engaging section;

FIGS. 5A to 5C are explanatory diagrams showing a monochromatic developing position of the developing device unit, wherein FIG. 5A shows an external configuration of the developing device unit and the photosensitive drum unit, FIG. 5B is a partially enlarged view of FIG. 5A, and FIG. 5C shows an internal configuration of the developing device unit and the photosensitive drum unit;

DETAILED DESCRIPTION

A multifunctional peripheral (hereinafter simply referred to as "MFP") as an image forming device according to one embodiment of the present invention will be described with reference to FIGS. 1 through 8.

Note that, directions will be used throughout the description assuming that the MFP is disposed in an orientation in which a user intends to use the MFP. More specifically, a term "front side" designates the right side of the MFP in FIG. 1, while a term "rear side" designates the left side of the MFP in FIG. 1. Also, a far side in FIG. 1 with respect to the paper width direction will be referred to as a "right side" while a near side in FIG. 1 with respect to the paper width direction will be referred to as a "left side". Further, an up-to-down direction in FIG. 1 will be referred to as a "vertical direction".

Figure 1:
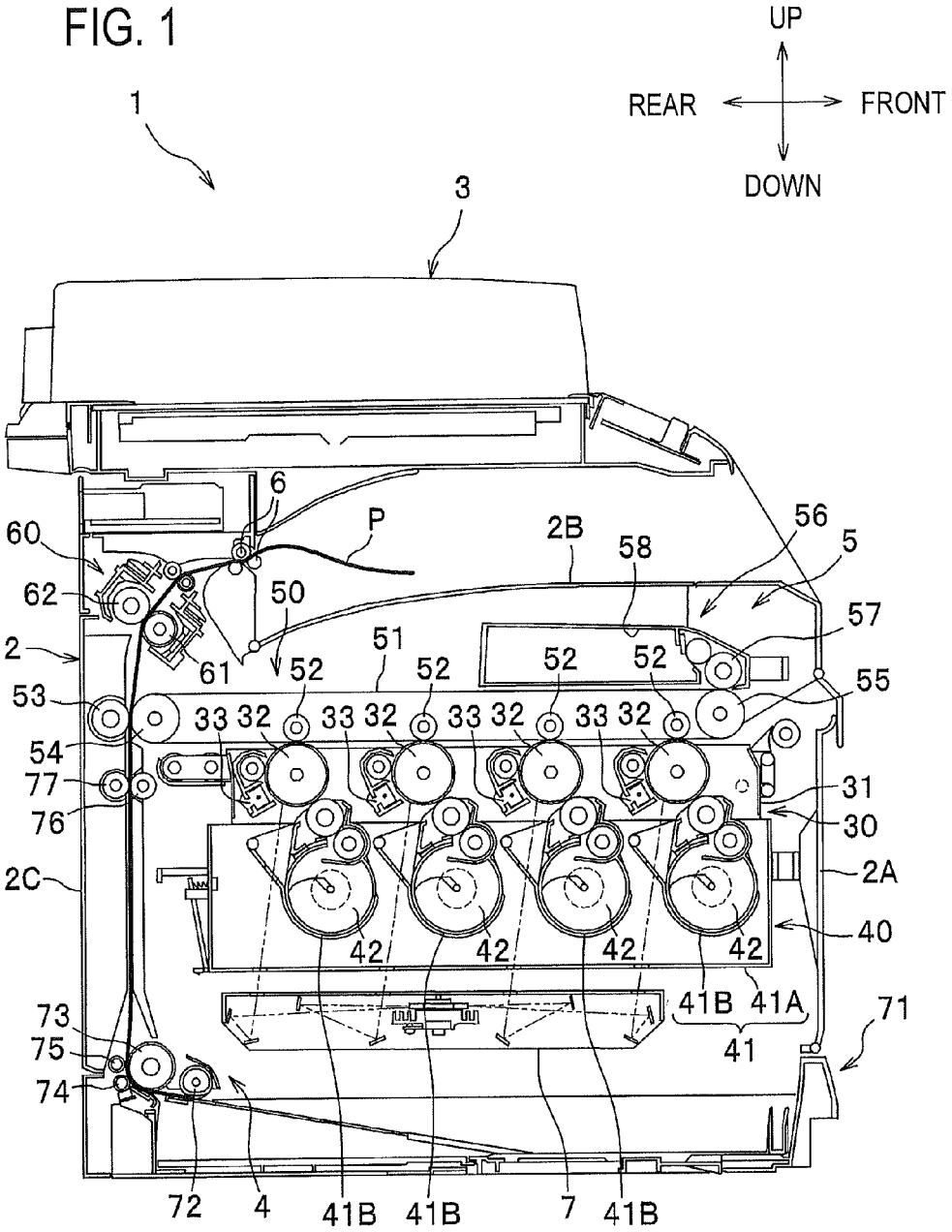
FIG. 1 is a schematic cross-sectional view illustrating a configuration of a multifunctional peripheral as an image forming device according to an embodiment of the present invention.

As shown in FIG. 1, the MFP 1 includes a main casing 2, and a flat head scanner 3 disposed in an uppermost portion of the main casing 2. In more detail, the MFP 1 includes a sheet feed unit 4, an image forming unit 5, a pair of discharge rollers 6, and an exposure unit 7. The sheet feed unit 4 feeds sheets of paper (hereinafter simply referred to as 'sheet P') as an example of a recording sheet, the image forming unit 5 forms images on the sheet P supplied from the sheet feed unit 4, and the discharge rollers 6 discharge the sheet P on which images are formed by the image forming unit 5. The exposure unit 7 exposes a photosensitive drum 32 (described later) to light.

A front cover 2A is provided in the front side of the main casing 2, and the front cover 2A has a bottom end pivotably supported to the main casing 2. The front door 2A is, therefore, allowed to pivotally move in a front-to-rear direction about the bottom end thereof.

A discharge tray 2B is provided in an upper portion of the main casing 2. The sheet P discharged out of the main casing 2 is piled in the discharge tray 2B. A rear cover 2C is provided in the rear side of the main casing 2.

The flat head scanner 3 is a conventional image scanning device. The flat head scanner 3 irradiates light onto a sheet and scans images on the sheet, and generates image data according to the scanned images.

The sheet feed unit 4 is disposed in a bottom portion of the main casing 2. The sheet feed unit 4 includes a sheet feed cassette 71, a separation roller 72, sheet feed rollers 73, 74 and 75, a first conveying roller 76, and a second conveying roller 77. The sheet feed cassette 71 is configured to be detachably mounted in the main casing 2 and accommodates sheets P in a stacked state. The separation roller 72 and sheet feed rollers 73, 74 and 75 are disposed rearward and upward of the sheet feed cassette 4 in the main casing 2. The first conveying roller 76 is disposed rearward of a photosensitive drum unit 30 (described later), and the second conveying roller 77 is disposed in opposition to the first conveying roller 76. The separation roller 72 picks up one sheet at a time out of the sheets P stacked in the sheet feed cassette 71. The sheet feed rollers 73, 74 and 75 then convey the sheet P upward. Subsequently, the first conveying roller 76 and the second conveying roller 77 nip the conveyed sheet P therebetween and convey the sheet P to the image forming unit 5.

The image forming unit 5 mainly includes a photosensitive drum unit 30, a developing device unit 40, a transfer unit 50 and a fixing unit 60.

Figure 2A:
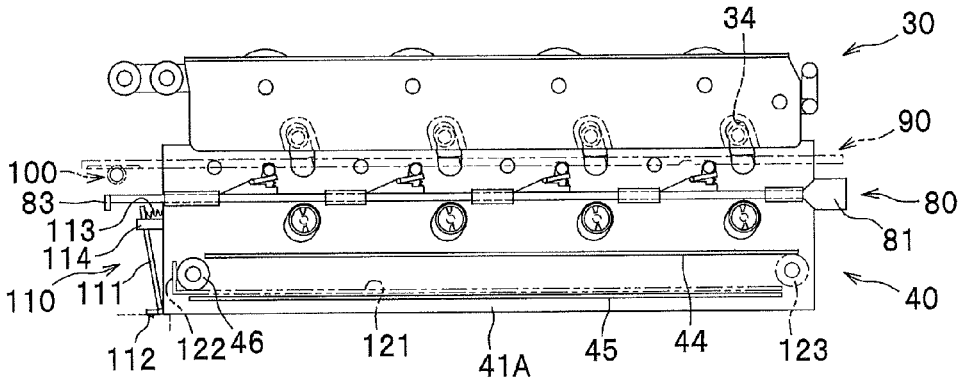
Figure 2B:
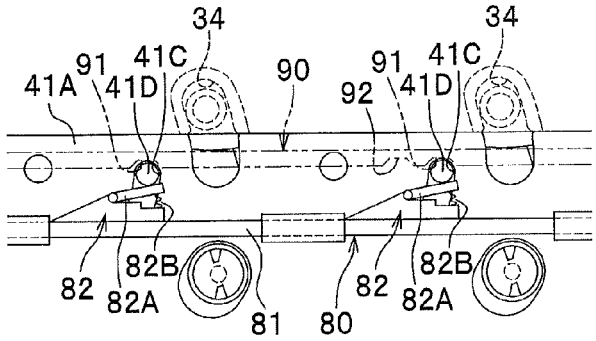
Figure 2C:
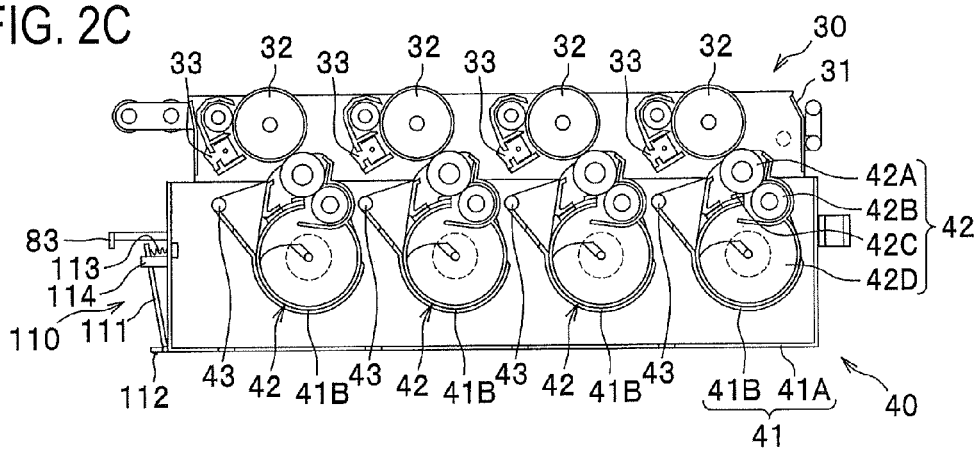

As shown in FIG. 2C, the photosensitive drum unit 30 includes a supporting frame 31, four photosensitive drums 32, and a Scorotron charger 33. The supporting frame 31 constitutes an outer surface of the photosensitive drum unit 30, thereby defining an outline thereof. Openings are formed in upper and bottom surfaces of the supporting frame 31.

The developing device unit 40 includes a supporting member 41 and four developing cartridges 42, as shown in FIG. 2C.

The supporting member 41 includes a frame 41A constituting an outer surface of the supporting member 41, and four developing device holders 41B for supporting the developing cartridges 42. An opening is formed in an upper surface of the frame 41A, while another opening is formed in a bottom surface thereof. Each of the developing cartridges 42 is detachably mounted in each developing device holder 41B. The developing device holder 41B has an axis 43 at the rear side thereof. The axis 43 is fixed to the frame 41A, thereby allowing the developing device holder 41B to be pivotably movably supported to the frame 41A about the axis 43.

The developing cartridge 42 includes a developing roller 42A, a supply roller 42B, a thickness-regulating blade 42C and a toner accommodating chamber 42D. Note that all of the four developing cartridges 42 have a configuration the same as each other except in that each accommodates toner of a different color in respective toner accommodating chamber 42D. When the developing device unit 40 is mounted in the main casing 2, each developing roller 42A supported by respective developing device holder 41B comes into contact with respective ones of the photosensitive drums 32 upward and rearward of the developing roller 42A, as shown in FIG. 1. When the photosensitive drum unit 30 is mounted in the main casing 2, each photosensitive drum 32 comes in contact with each of the developing rollers 42A at the diagonally bottom of the photosensitive drum 32, while being in contact with respective ones of first transfer rollers 52 (described later) via an intermediate transfer belt 51 (described later) at the top of the photosensitive drum 32.

As shown in FIG. 1, the transfer unit 50 is disposed between the photosensitive drum unit 30 and the discharge tray 2B in the main casing 2. The transfer unit 50 includes an intermediate transfer belt 51, four first transfer rollers 52, a second transfer roller 53, a drive roller 54, a follow roller 55, and a cleaning unit 56.

The drive roller 54 and the follow roller 55 are disposed with a distance therebetween in the front-to-rear direction. The intermediate transfer belt 51 is an endless belt, and is stretched around the drive roller 54 and the follow roller 55. The intermediate transfer belt 51 opposes and contacts each of the photosensitive drums 32 at the bottom portion of the outer circumferential surface of the intermediate transfer belt 51. The second transfer roller 53 is disposed in opposition to and in contact with the intermediate transfer belt 51 at a rear end portion of the intermediate transfer belt 51.

The first transfer rollers 52 are rotatably provided inside the loop of the intermediate transfer belt 51 so as to be in contact with the back side of the bottom portion of the inner circumferential surface of the intermediate transfer belt 51. Each of the first transfer rollers 52 is disposed in opposition to each of the photosensitive drums 32 so that the intermediate transfer belt 51 can be nipped therebetween.

The second transfer roller 53 is provided in the rear cover 2C and is disposed in a position opposing to the drive roller 54 so that the intermediate transfer belt 51 can be nipped therebetween. A transfer bias is applied to the first transfer rollers 52 and the second transfer roller 53 under a constant current control during transfer operations.

The cleaning unit 56 is disposed above the front portion of the intermediate transfer belt 51. The cleaning unit 56 is provided with a cleaning roller 57 and a toner accumulation section 58 disposed rearward of the cleaning roller 57. The cleaning roller 57 cleans up the toner remained on the outer circumferential surface of the intermediate transfer belt 51, and the removed toner is then stored in the toner accumulation section 58.

The fixing unit 60 is disposed above the rear portion of the intermediate transfer belt 51. The fixing nit 60 includes a heat roller 61 and a pressure roller 62 disposed in opposition to the heat roller 61. The pressure roller 62 applies pressure to the heat roller 61.

Next, operations performed in the image forming unit 5 having the above-described configuration will be described.

In the image forming unit 5, each Scorotron charger 33 applies a uniform charge to the surface of each photosensitive drum 32, and the exposure unit 7 then irradiates a laser to the surface of the photosensitive drum 32 to perform exposure. In this way, a lower potential is produced on areas exposed to the laser beam on the surface of the photosensitive drum 32, thereby forming an electrostatic latent image on the surface of each photosensitive drum 32 according to the scanned image data.

Meanwhile, as the supply roller 42B rotates, the toner accommodated in the toner accommodating chamber 42D is supplied to the developing roller 42A. In accordance with the rotation of the developing roller 42A, the toner supplied to the surface of the developing roller 42A passes between the thickness-regulating blade 42C and the developing roller 42A, thereby maintaining a thin layer of uniform thickness on the surface of the developing roller 42A. The toner is thus carried on the circumferential surface of the developing roller 42A.

When each developing roller 42A comes into contact with respective ones of the photosensitive drums 32, the toner borne on the surface of the developing roller 42A is supplied to the surface of each photosensitive drum 32 on which the electrostatic latent image is formed, thus being selectively carried thereon. In this way, the latent image on each of the photosensitive drums 32 is developed into a visible toner image. The toner images in each color borne on the surface of each photosensitive drum 32 are then sequentially transferred onto the outer circumferential surface of the intermediate transfer belt 51 in conjunction with the transfer bias applied to the four first transfer rollers 52.

When the sheet P conveyed to the image forming unit 5 passes between the intermediate transfer belt 51 and the second transfer roller 53, the toner images transferred on the intermediate transfer belt 51 are then transferred onto the surface of the sheet P in cooperation with the transfer bias applied to the second transfer roller 53. The sheet P is then conveyed to the fixing unit 6, whereby the toner images transferred on the surface of the sheet P is thermally-fixed thereto as the sheet P passes between the heat roller 61 and the pressure roller 62. The sheet P is finally discharged out of the main casing 2 onto the discharge tray 2B by the rotation of the discharge rollers 6.

Next, detailed configurations for enabling the photosensitive drum unit 30 and the developing device unit 40 to be detachably mountable in the main body 2 will be described while referring to FIGS. 2A to 5. Note that, although FIGS. 2A to 5 only show configurations seen from the left side of the MFP 1 and the descriptions therefor only are given hereinafter, the same configurations are also provided on the right side of the MFP 1.

As shown in FIGS. 2A and 2B, four through-holes 41C are formed on left and right side walls of the frame 41A, i.e., on walls disposed in a direction orthogonal to the rotational axis of the developing roller 42A. An operation portion 41D is provided in the developing device holder 41B so that each operation portion 41D can protrude outward from each through-hole 41*c*. The through-hole 41C has a shape elongated in the vertical direction so that the operation portion 41D can be vertically movable. In addition, a first operation lever 80, a second operation lever 90, a second operation lever driving member 100, and a lock mechanism 110 are also provided in the MFP 1 as shown in FIG. 2A.

The first operation bar 80 is provided on the frame 41A. The first operation bar 80 includes two bars 81, sloping members 82, and two disengagement members 83. Each bar 81 is movably supported on the left and right side walls of the frame 41A and extends in the front-to-rear direction. The two bars 81 are connected at the front side of the frame 41A so as to be integrally movable relative to the frame 41A in the front-to-rear direction. Each developing roller 42A is juxtaposed in the front-to-rear direction, and the bars 81 are thus configured to be movable along a direction orthogonal to the axes of the four developing rollers 42A. Each of the sloping members 82 is adapted to be engageable with each of the operation portions 41D. The sloping member 82 has an upper surface sloped diagonally downward from the front to the rear thereof. The sloped upper surface has a front half portion serving as a pivotable member 82A configured to be pivotably movable in the vertical direction about the rear end of the pivotable member 82A. A spring 82B is provided to bias the pivotable member 82A upward from the bottom thereof. The disengagement member 83 is provided at the rear end of each operation bar 81 so as to protrude downward therefrom.

The second operation bar 90 is provided in the main casing 2 and illustrated by double dotted chain lines in FIGS. 2A and 2B. The second operation bar 90 includes four first recesses 91 and a second recess 92. Each first recess 91 is adapted to be engageable with each of the operation portions 41D. The first recesses 91 are arranged in line with an interval interposed therebetween, the interval being the same as that between each of the operation portions 41D. The second recess 92 is configured to be engageable only with the operation portion 41D located at a position closest to the front side of the MFP 1.

The second operation bar driving member 100 is provided on the second operation bar 90, and is configured to meshingly engage the second operation bar 90 at the rear end thereof. A control unit (not shown) controls the second operation bar driving member 100 to rotate so that the second operation bar 90 can be slidingly movable in the front-to-rear direction.

The lock mechanism 110 is provided on the frame 41A at the rear end thereof. The lock mechanism 110 includes a rod-like member 111, a hook portion 112, a biasing member 113, and a holding member 114. The hook portion 112 is formed at the bottom end of the rod-like member 111. The biasing member 113 biases the upper end portion of the rod-like member 111 away from the frame 41A, i.e., to the rear. The holding member 114 holds the upper end portion of the rod-like member 111 and prevents the rod-like member 113 from falling off the frame 41A. When the developing device unit 40 is completely mounted in the main body 2 and the first operation bar 80 is pushed rearward, the hook portion 112 is configured to protrude downward so that a hook engaging portion 2D formed in the main casing 2 can engage the hook portion 112 (Refer to FIG. 4D).

As shown in FIGS. 2A, 2B, 3A, 3B, 4A and 4B, the photosensitive drum unit 30 is provided with four grooves 34 on left and right side walls of the supporting frame 31. The grooves 34 engage the rotational axes of the developing rollers 42A so as to guide the movement of developing rollers 42A, as well as to position the developing rollers 42A relative to the photosensitive drums 32.

As shown in FIGS. 2A and 2B, each of the operation portions 41D are placed on each pivotable member 82A of the sloping members 82, and the pivotable member 82A is biased upward by the spring 82B. Each of the operation portion 41D is thus engaged with corresponding first recess 91 of the second operation bar 90. At this time, four developing rollers 42A are brought into such a position that each of the four developing rollers 42A can be in contact with respective ones of the photosensitive drums 32, as shown in FIG. 2C. When four developing rollers 42A are placed at this position, the MFP 1 can utilize the four photosensitive drums 32, thereby performing a color developing operation. Therefore, this position is called a color developing position. In this state, upper portions of the developing rollers 42A and lower portions of the photosensitive drums 32 overlap when seen from the front side of the MFP 1.

Figure 3A:
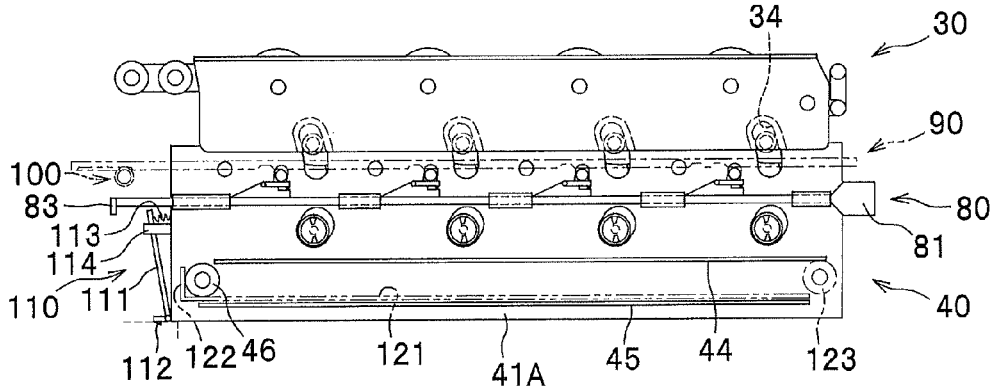
Figure 3B:
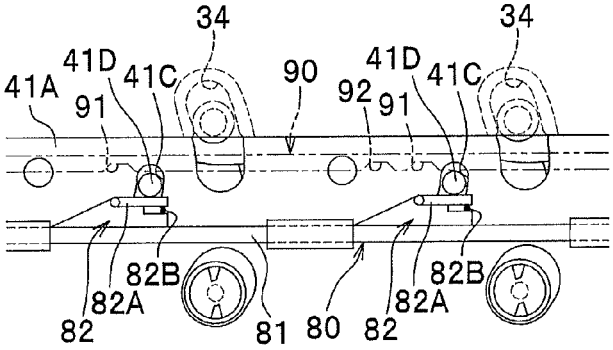
Figure 3C:
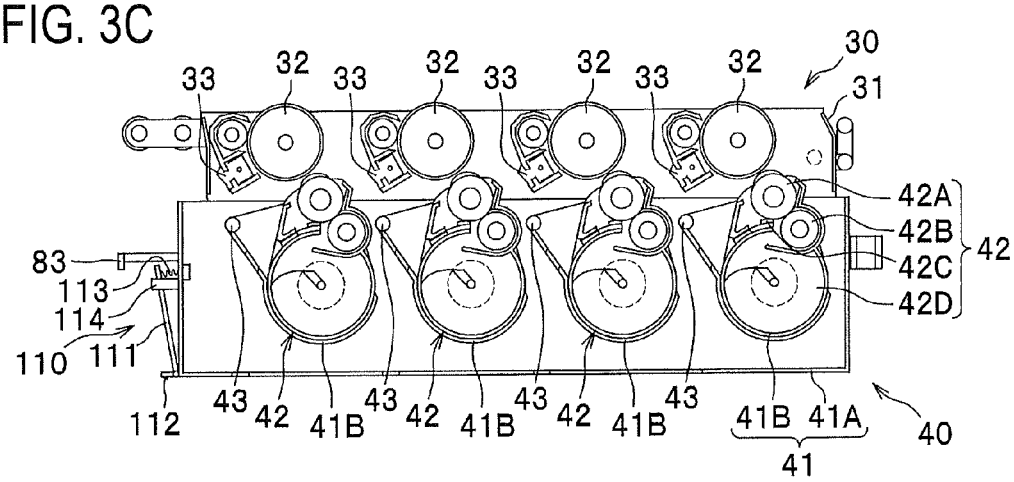

When the second operation bar driving member 100 moves the second operation bar 90 rearward from the color developing position shown in FIGS. 2A and 2B, each of the operation portions 41D is released from the engagement with the corresponding first recesses 91 of the second operation bar 90 as shown in FIGS. 3A and 3B. At this time, four developing rollers 42A are slightly spaced apart from the corresponding photosensitive drums 32 respectively as shown in FIG. 3C. This position is called an intermediate position, where the cleaning unit 56 can perform a cleaning operation at the MFP 1, for example.

Figure 4A:
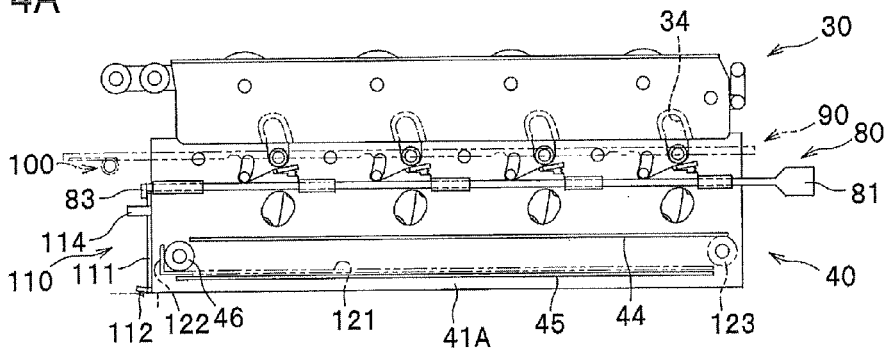
Figure 4B:
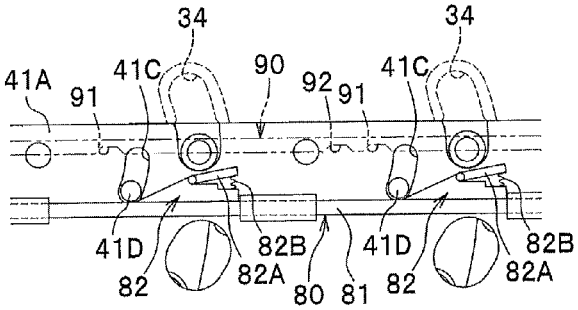
Figure 4C:
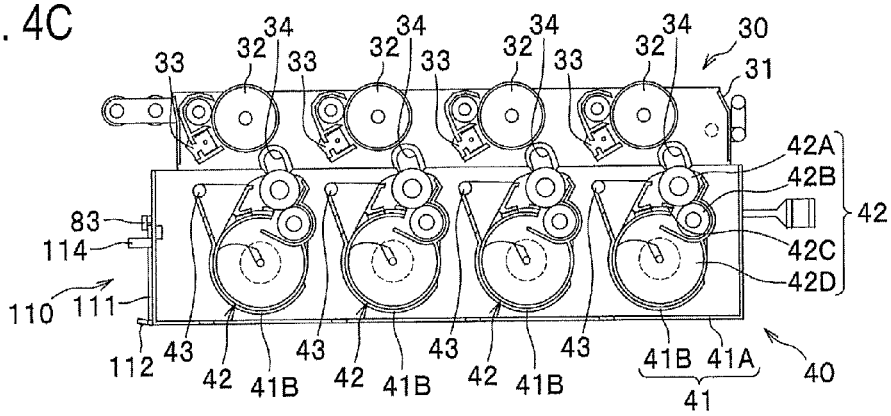
Figure 4D:
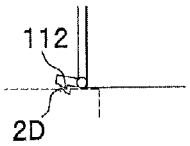

When a user pulls the first operation bar 80 forward from the color developing position shown in FIGS. 2A and 2B, the engagement between each operation portion 41D and each sloping member 82 of the first operation bar 80 is released as shown in FIGS. 4A and 4B. At this time, four developing rollers 42A are spaced apart from the corresponding photosensitive drums 32 and are completely accommodated in the frame 41A. In other words, the developing rollers 42A are displaced into a position where the upper portions of the developing rollers 42A do not overlap with the lower portions of the photosensitive drums 32 when seen from the front side of the MFP 1. Therefore, the photosensitive drums 32 and the developing rollers 42A do not interfere with each other when either the photosensitive drum unit 30 or the developing roller unit 40 is pulled out from the main casing 2. This position is thus called a detachable position.

At the same time, when the user pulls the first operation bar 80 forward, the disengagement member 83 of the first operation bar 80 is coupled to the upper portion of the rod-like member 111, thereby pivotally moving the same. Hence, the hook portion 112 is moved upward, thereby releasing the engagement with the main casing 2 (more precisely, engagement with the hook engaging portion 2D). In this way, at least one of the developing device unit 40 and photosensitive drum unit 30 are made detachable from the main casing 2.

In the present embodiment, a pair of first guides 44 and 45 and a first wheel 46 are provided on outer surfaces of the left and right side walls of the frame 41A of the developing device unit 40 for facilitating detachment of the developing device unit 40. The first guides 44 and 45 extend in the front-to-rear direction, and the first wheel 46 is disposed at the rear end of both side walls of the frame 41A. In the main casing 2, a second guide 121, a stopper 122, and a second wheel 123 are provided for the same purpose. The second guide 121 is formed along the first guide 45. The stopper 122 is disposed at the rear end of the second guide 121 for preventing the first wheel 46 from moving further to the rear, while the second wheel 123 is disposed at the front end of the second guide 121. When a user pulls the first operation bar 80 forward, the second wheel 123 rotates and the first guide 44 moves on the second wheel 123 in conjunction with the rotation of the second wheel 123, thereby enabling the developing device unit 40 to move forward. In the meantime, the first wheel 46 rotates along the second guide 121. The developing device unit 40 is thus pulled out from the main casing 2.

Figure 5A:
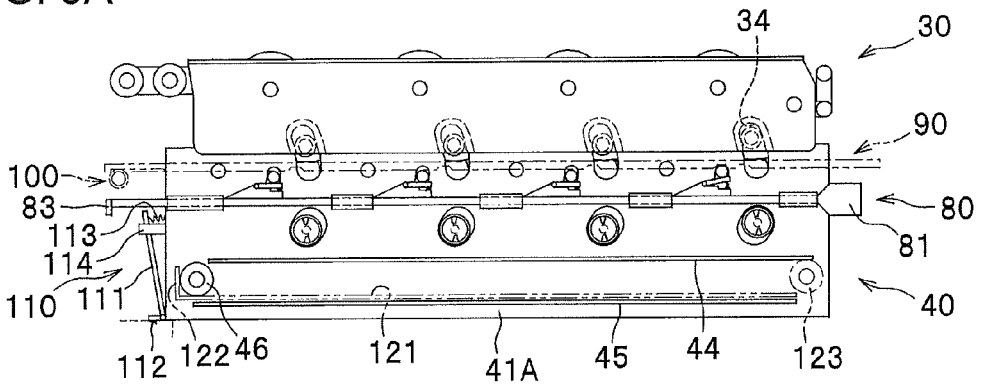
Figure 5B:
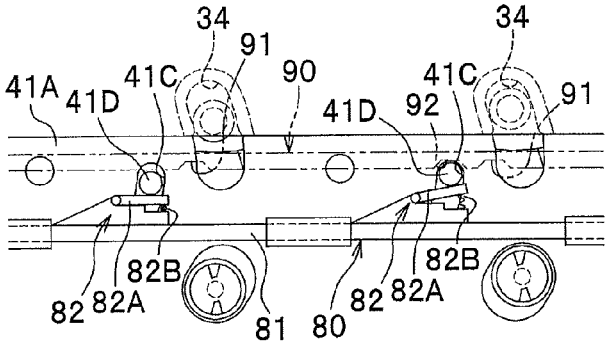
Figure 5C:
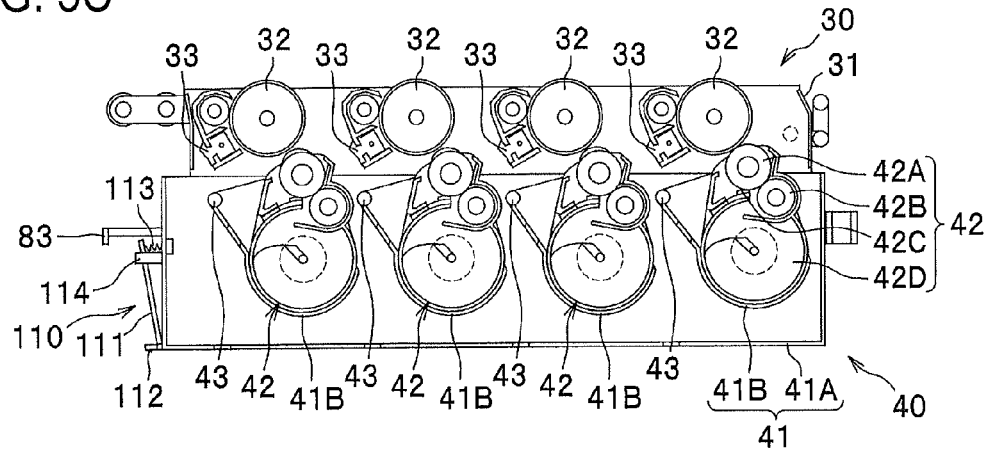

When the second operation bar driving member 100 moves the second operation bar 90 forward from the color developing position shown in FIGS. 2A and 2B, each operation portion 41D is disengaged from each of the first recesses 91 of the second operation bar 90, but only one of the operation portions 41D, which is located closest to the front of the MFP 1, is then brought into engagement with the second recess 92 as shown in FIGS. 5A and 5B. In this state, as shown in FIG. 5C, of the developing rollers 42A, the one closest to the front of the MFP 1 is at a developing position where the developing roller 42A is in contact with the corresponding photosensitive drum 32, while other three developing rollers 42A are slightly separated from respective photosensitive drums 32. Hence, the MFP 1 can perform monochromatic printing at this position using one of the photosensitive drums 32 located at the forefront in the main casing 2. This position is thus called a monochromatic developing position.

Next, operations for removing the photosensitive drum unit 30 and the developing device unit 40 from the main casing 2 will be described with reference to FIGS. 6 through 8. As shown in FIG. 7, a grip 35 is provided on the front portion of the outer surface of the supporting frame 31, while guide wheels 36 are provided on the rear portion of the outer surface of the supporting frame 31. Wheel accommodation sections 124 and guide sections 125 are also provided on left and right sides in the main casing 2, as shown in FIGS. 6 to 8.

Figure 6:
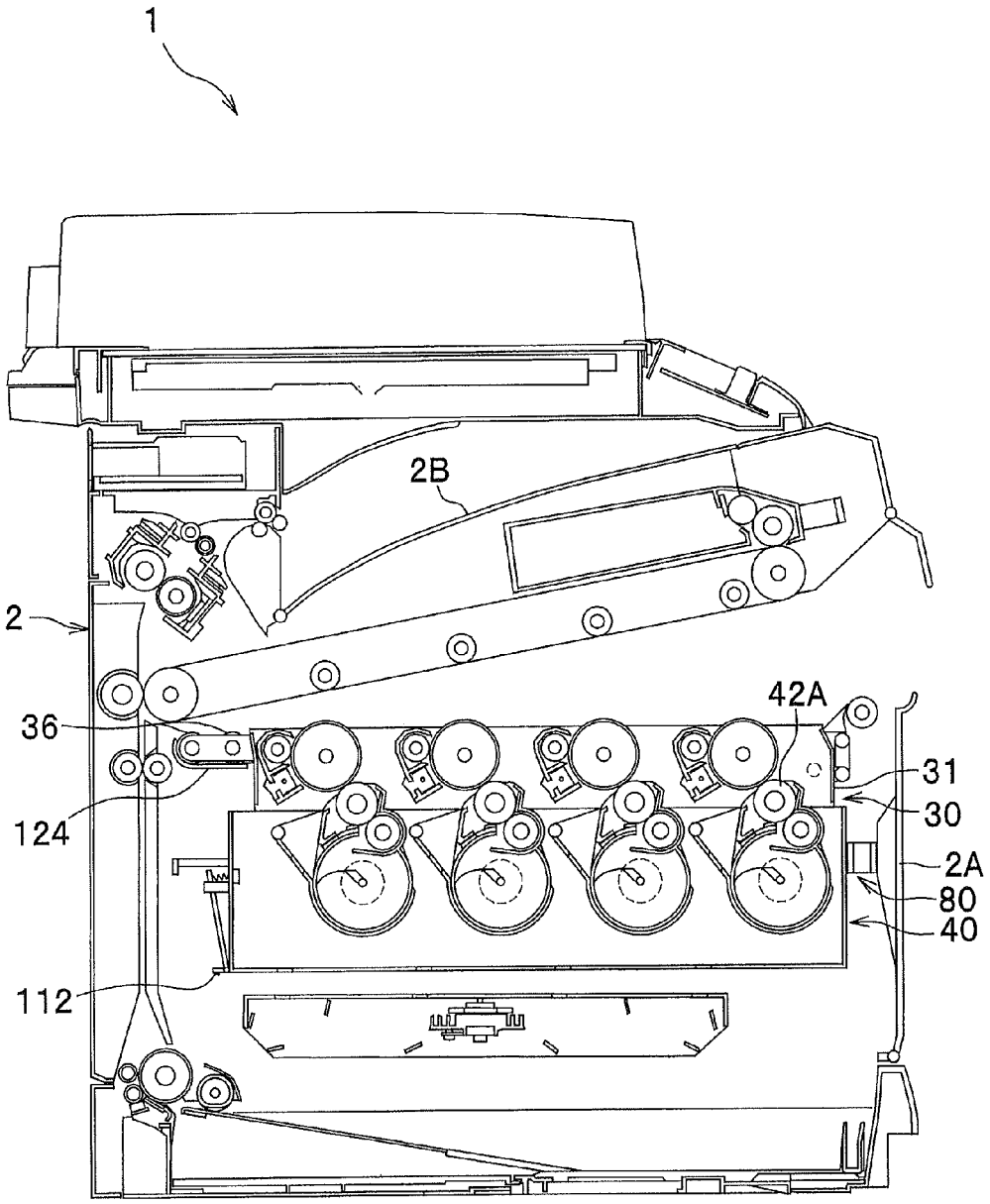
FIG. 6 is a schematic view illustrating a state in which a discharge tray is opened.
Figure 7:
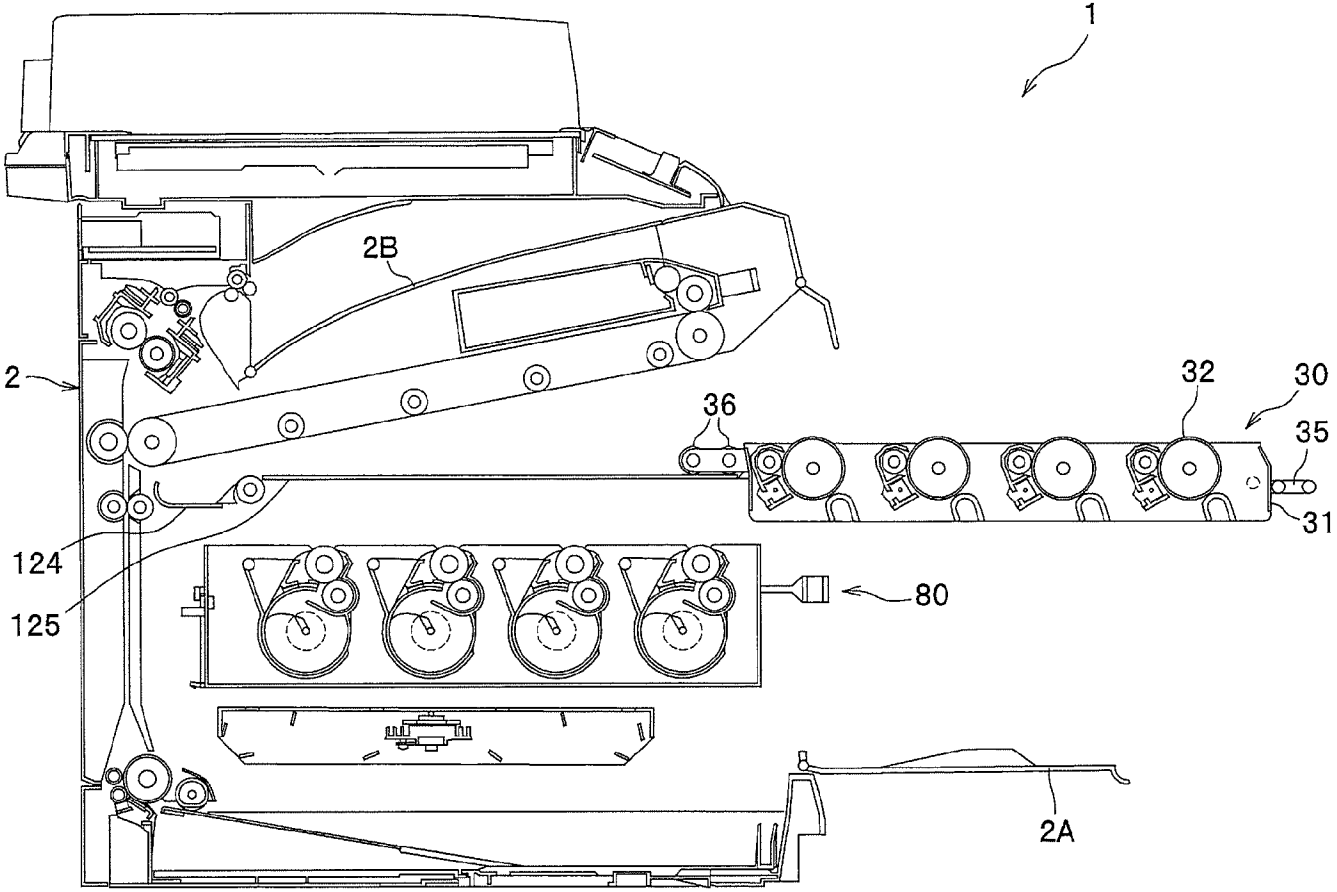
FIG. 7 is a schematic view illustrating a state in which the photosensitive drum unit is being pulled out.

First, a user opens the discharge tray 2B upward from a state shown in FIG. 1, as shown in FIG. 6. The user then opens the front cover 2A and pulls the first operation bar 80, thereby shifting the developing rollers 42A to the detachable position while releasing the hook portion 112 from the main body 2. The photosensitive drum unit 30 and the developing device unit 40 are thus ready to be pulled out.

At this time, when the user holds the grip 35 and pulls the same forward, the guide wheels 36 move onto the guide sections 125 from the wheel accommodation sections 124, and rotate along the guide sections 125. The user can thus pull the photosensitive drum unit 30 out of the main casing 2, and replace the photosensitive drums 32.

Figure 8:
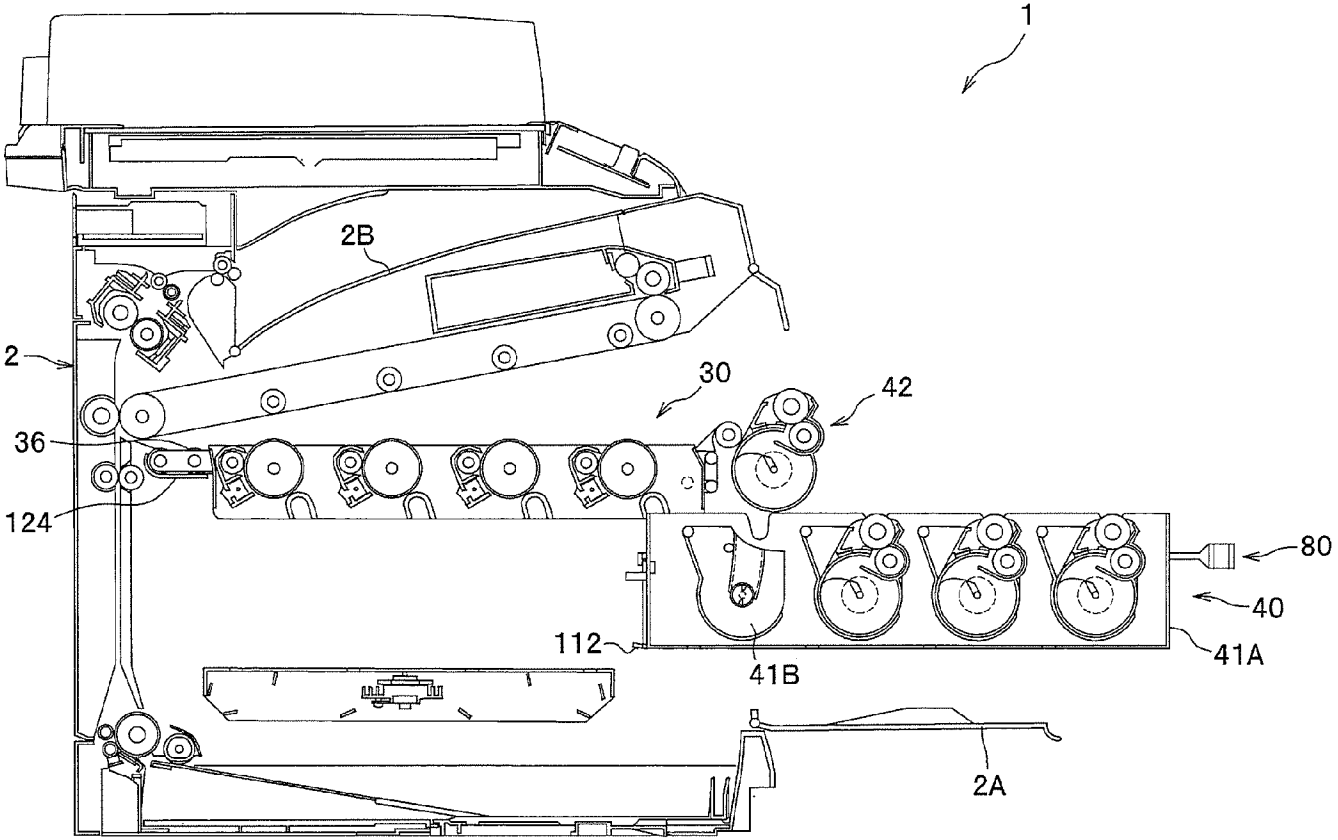
FIG. 8 is a schematic view illustrating a state in which the developing device unit is being pulled out.

Alternatively, as shown in FIG. 8, when the user pulls the first operation bar 80 forward, the developing device unit 40 can be pulled out from the main casing 2. At this time, the user can replace the developing cartridges 42 accommodated in the developing device holders 41B.

As described above, the plurality of developing cartridges 42 are designed to shift to the detachable position relative to the frame 41. Therefore, the user can only pull out the developing device unit 40 when detaching the developing device unit 40 from the main casing 2. In other words, the entire developing device unit 40 is not necessary to be supported when each of the developing cartridges 42 is spaced away from respective ones of the photosensitive drums 32, thereby achieving a simple-structured mechanism for detaching the developing device unit 40 from the main casing 2. Also, the user can simply pull out the developing device unit 40 when replacing the developing cartridges 42, leading to prevention of a fall of the main casing 2.

Further, positions of the developing cartridges 42 can be changed by manipulating the operation portions 41D protruding from the through-holes 41C formed on the side walls of the frame 41, thereby facilitating positional changes of the developing cartridges 42. Additionally, the operation portion 41D is formed on the developing device holder 41B which is pivotally supported to the frame 41A. Hence, the through-hole 41C is not necessary to be formed up to the upper peripheral end section of the frame 41A, thereby leading to high rigidity of the frame 41A.

The intermediate position realizes a slight separation between the developing cartridges 42 and the photosensitive drums 32 by shifting the developing cartridges 32 by a small amount, facilitating cleaning of the photosensitive drums 32 and the intermediate transfer belt 51.

Positions of the plurality of developing cartridges 42 are configured to be switchable between the color developing position and the monochromatic developing position. Hence, even if the MFP 1 runs out of color toner (cyan, yellow, and magenta), the MFP 1 can still perform monochromatic printing.

Further, since the grooves 34 are provided in the photosensitive drum unit 30 for engagement with the developing cartridges 42, the developing cartridges 42 can be easily positioned relative to the photosensitive drums 32.

Further, the positional change of the plurality of developing cartridges 42 between the color developing position and the detachable position can be easily realized by simply operating the first operation bar 80. At the same time, since the first operation bar 80 is provided on the frame 41A, the first operation bar 80 does not interfere with the operation portions 41D when the developing device unit 40 is being removed from the main casing 2.

Likewise, simply operating the first operation bar 80 and the second operation bar 90 allows the plurality of developing cartridges 42 to change the position thereof easily from any one of the color developing position, the detachable position and the intermediate position to another. Also, since the first operation bar 80 and the second operation bar 90 are provided in the front-to-rear direction with respect to the developing device unit 40, the developing device unit 40 can be removed from the main casing 2 without being interrupted.

Further, the grooves 34 formed on the photosensitive drum unit 30 facilitate positioning of axial ends of each developing roller 42A. Therefore, the rotational axes of the respective pair of the photosensitive drum 32 and the corresponding developing roller 42A are reliably maintained in parallel to each other.

Although the present invention has been described with respect to the specific embodiment thereof, it will be appreciated by one skilled in the art that a variety of changes may be made without departing from the scope of the invention.

More specifically, the developing device holder 41B is pivotally supported to the frame 41A in the above-described embodiment. But, as a variation, the developing device unit 40 may be configured to allow the developing devices having developing rollers to be slidably movable relative to the supporting member.

The photosensitive drum unit 30 and the developing device unit 40 are arranged to be pulled out from the front side of the main body 2 in the front-to-rear direction in the above-described embodiment. However, the photosensitive drum unit 30 and the developing device unit 40 may be configured to be taken out from either left or right side of the main body 2 of the MFP 1.

Further, the developing roller 42A is arranged to be in contact with the photosensitive drum 32 in the developing positions (both color and monochromatic) in the above-described embodiment. However, as long as printing operations can be performed on the surfaces of the photosensitive drums 32, the developing roller 42A may be placed in a position close to, but spaced apart from the photosensitive drum 32 in the developing positions. That is, in this embodiment, the developing rollers 42A may be disposed in proximity to the photosensitive drums 32, regardless of whether or not the developing rollers 42A are in direct contact with the photosensitive drums 32.

In the above embodiment, the first recesses 91 and the second recess 92 are formed on the second operation bar 90 and each is designed to be engageable with respective one of the operation portion 41A. In accordance with movements of the second operation bar 90, the developing rollers 42A and the photosensitive drums 32 are brought in close to each other when the operation portions 41D are engaged with either the first recesses 91 or the second recess 92, while the developing rollers 42A and the photosensitive drums 32 are in separation to each other when the operation portions 41D are disengaged from either the first recesses 91 or the second recess 92. However, protrusions may be formed on the lower surface of the second operation bar 90 instead of the first recesses 91 and the second recess 92. In this case, in accordance with the movements of the second operation bar 90, the developing rollers 42A and the photosensitive drums 32 are configured to be distanced from each other when the protrusions push the operation portions 41D downward, while the developing rollers 42A and the photosensitive drums 32 are configured to be positioned close to each other when the operation portions 41D are in a position off the protrusions. Note that, in this case, too, as long as the MFP 1 can perform printing, the developing rollers 42A may not necessarily be in direct contact with the photosensitive drums 32, but may be disposed in a position slightly distanced from the photosensitive drums 32.

Further, this invention can be applied to a color copier, and also to a color printer that is not provided with an image scanning unit (a flat head scanner).

As a light source, the exposure unit 7 employs a laser in the above-described embodiment. However, LEDs, electroluminescence elements and florescent materials may also be an alternative light source.

What is claimed is:

1. An image forming apparatus comprising:

a main casing comprising:

a front door configured to move between an open position where the front door is open and a closed position where the front door is closed;

a rear wall; and a bottom portion, a belt;

a developing device that is closer to the bottom portion of the main casing than the belt, the developing device being configured to move between a first position and a second position closer to the bottom portion of the main casing than the first position, the developing device comprising:

a developing roller;

a developing accommodating chamber configured to accommodate developer therein, the developing accommodating chamber being closer to the bottom portion of the main casing than the developing roller;

a supply roller configured to supply developer to the developing roller; and a blade configured to regulate a thickness of developer on the developing roller, a bar configured to move between a third position and a fourth position closer to the rear wall than the third position; and a pressing member comprising:

a pressing portion; and a spring that is closer to the bottom portion of the main casing than the pressing portion and presses the pressing portion, wherein the pressing portion of the pressing member is configured to press the developing device when the bar is disposed at the fourth position.

2. The image forming apparatus according to claim 1, wherein the supply roller is closer to the bottom portion of the main casing than the developing roller.

3. The image forming apparatus according to claim 1, wherein the pressing member is a sloping member comprising:

a sloped surface, and a pivotable member configured to pivot, the pivotable member being the pressing portion and being pressed by the spring.

4. The image forming apparatus according to claim 1, wherein the bar is elongated in a direction parallel to an axis of the developing roller.

5. The image forming apparatus according to claim 1, wherein the bar comprises:

a front edge disposed closer to the rear wall of the main casing than the developing device when the bar is disposed at the third position, and a rear edge disposed closer to the front door of the main casing than the developing device when the bar is disposed at the fourth position.

6. The image forming apparatus according to claim 1, wherein the front door is configured to partially overlap, when the front door is at the opened position, the bar at the third position, when viewed in a direction perpendicular to both a front-rear direction and an axial direction of the developing roller.

7. The image forming apparatus according to claim 6, wherein the front-rear direction and the axial direction of the developing roller are not parallel.

8. An image forming apparatus comprising:

a main casing comprising:

a front door configured to move between an open position where the front door is open and a closed position where the front door is closed;

a rear wall; and a bottom portion, a belt;

a cartridge that is closer to the bottom portion of the main casing than the belt when the cartridge is mounted in the main casing, the cartridge being configured to move between a first position and a second position closer to the belt than the first position; and a bar configured to move between a third position and a fourth position closer to the rear wall than the third position, the bar comprising:

a pressing portion; and a spring that is closer to the bottom portion of the main casing than the pressing portion and presses the pressing portion, wherein the pressing portion is configured to press the cartridge to the second position when the bar is disposed at the fourth position.

9. The image forming apparatus according to claim 8, wherein the cartridge includes a developing roller, and wherein the bar is elongated in an elongated direction parallel to an axis of the developing roller.

10. The image forming apparatus according to claim 9, wherein the bar is configured to move between the third position and the fourth position in the elongated direction.

11. The image forming apparatus according to claim 10, wherein the front door is configured to partially overlap, when the front door is at the opened position, the bar at the third position, when viewed in a direction perpendicular to both a front-rear direction and an axial direction of the developing roller.

12. The image forming apparatus according to claim 8, wherein the bar comprises a front edge disposed closer to the rear wall of the main casing than the cartridge when the bar is disposed at the third position.

13. The image forming apparatus according to claim 8, wherein the bar comprises a rear edge disposed closer to the front door of the main casing than the cartridge when the bar is disposed at the fourth position.

* * * * *